US007695340B2

(12) United States Patent
Nakazato et al.

(10) Patent No.: US 7,695,340 B2
(45) Date of Patent: Apr. 13, 2010

(54) ACTION FIGURE TOY

(75) Inventors: Makoto Nakazato, Redondo Beach, CA (US); Ted Lubin, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 641 days.

(21) Appl. No.: 11/557,458

(22) Filed: Nov. 7, 2006

(65) Prior Publication Data

US 2007/0141948 A1 Jun. 21, 2007

Related U.S. Application Data

(60) Provisional application No. 60/734,894, filed on Nov. 8, 2005.

(51) Int. Cl.
*A63H 3/00* (2006.01)
*A63H 3/18* (2006.01)
*A63H 3/20* (2006.01)

(52) U.S. Cl. ..... 446/268; 446/323; 446/330; 446/359

(58) Field of Classification Search ..... 446/323, 446/330, 359, 268
See application file for complete search history.

(56) References Cited

U.S. PATENT DOCUMENTS

| | | | |
|---|---|---|---|
| 240,510 | A | 4/1881 | Farnum |
| 243,439 | A | 6/1881 | Farnum |
| 257,952 | A | 5/1882 | Kennish |
| 731,051 | A | 6/1903 | Hills |
| 1,211,479 | A | 3/1917 | Myers |
| 1,332,601 | A | 3/1920 | Burke, Sr. |
| 1,354,577 | A | 10/1920 | Olson |
| 1,394,096 | A | 10/1921 | Lacey |
| 1,439,634 | A | 12/1922 | Mosansky |
| 1,472,842 | A | 11/1923 | Hyman |
| 1,961,081 | A | 5/1934 | Schrader |

(Continued)

FOREIGN PATENT DOCUMENTS

| | | |
|---|---|---|
| DE | 404240 | 10/1924 |

(Continued)

OTHER PUBLICATIONS

International Search Report and Written Opinion from PCT/US06/43506 dated Sep. 27, 2007.

(Continued)

*Primary Examiner*—Gene Kim
*Assistant Examiner*—Michael D Dennis
(74) *Attorney, Agent, or Firm*—Kolisch Hartwell, P.C.

(57) ABSTRACT

An action figure toy may include a base, an action figure, and a flipping mechanism disposed on the base. In some embodiments, the action figure toy may include at least two cords suspended from the base, and the action figure may be configured to ascend the at least two cords toward the base by manipulation of the at least two cords by a user. The flipping mechanism may be configured to engage the action figure when the action figure ascends to the flipping mechanism. The flipping mechanism may enable the action figure to rotate about an axis that is transverse to a line parallel to at least a portion of at least one of the at least two cords when the flipping mechanism engages the action figure.

8 Claims, 3 Drawing Sheets

U.S. PATENT DOCUMENTS

| | | | | |
|---|---|---|---|---|
| 2,064,119 | A | 12/1936 | Irenius | |
| 2,550,065 | A | 4/1951 | Hallum | |
| 2,565,096 | A | 8/1951 | Schelm | |
| 2,651,140 | A | 9/1953 | Kovac | |
| 2,766,551 | A | 10/1956 | Almoslino | |
| 3,179,994 | A | 4/1965 | Meyer et al. | |
| 3,393,470 | A | 7/1968 | Salvador | |
| 3,600,843 | A | 8/1971 | Becker | |
| 3,701,215 | A | 10/1972 | Marason, Jr. et al. | |
| 3,852,943 | A | 12/1974 | Healy | |
| 3,863,385 | A | 2/1975 | Becker | |
| 3,893,256 | A * | 7/1975 | Wolf et al. | 446/228 |
| 3,925,924 | A | 12/1975 | Schoenfield | |
| 3,977,122 | A * | 8/1976 | Meyer et al. | 446/268 |
| 4,056,896 | A | 11/1977 | Karasawa | |
| 4,080,750 | A | 3/1978 | Palumbo | |
| 4,253,219 | A | 3/1981 | Krasnov | |
| 4,302,902 | A | 12/1981 | Adler | |
| 4,391,064 | A * | 7/1983 | Lakin et al. | 446/227 |
| 4,576,586 | A | 3/1986 | Amici et al. | |
| 4,881,622 | A | 11/1989 | Machal | |
| 5,316,301 | A | 5/1994 | Boury | |
| 5,320,572 | A | 6/1994 | Chen | |
| 5,362,271 | A | 11/1994 | Butt | |
| 5,727,981 | A | 3/1998 | Meng-Suen | |
| 5,743,781 | A | 4/1998 | Lee | |
| 5,759,082 | A | 6/1998 | Kujawski et al. | |
| 6,132,285 | A | 10/2000 | Feldman | |
| 6,171,169 | B1 * | 1/2001 | Saunders | 446/308 |
| 6,537,129 | B1 * | 3/2003 | Kane | 446/323 |
| 6,712,667 | B1 | 3/2004 | Melzer et al. | |
| 6,776,682 | B2 | 8/2004 | Engel et al. | |

FOREIGN PATENT DOCUMENTS

| | | | |
|---|---|---|---|
| GB | 2197216 | A | 5/1988 |

OTHER PUBLICATIONS www.veggiegear.com/larryboystuff.html webpage dated Feb. 8, 2004 [retrieved Jun. 22, 2007 from Internet Archive Wayback Machine http://www.archive.org/web/web.php] from the Internet:<URL: http//web.archive.org/web/20040208141642/http://www.veggiegear.com/larryboystuff.html> (4 pages).

www.veggiegear.com/larryboyplush.html webpage dated May 1, 2004 [retrieved Jun. 22, 2007 from Internet Archive Wayback Machine http://www.archive.org/web/web.php] from the Internet: URL: http://web.archive.org/web/20040501015532/www.veggiegear.com/larryboyplush.html> (2 pages).

www.megomuseum.com/catalog/1979/Index.shtml webpage dated Dec. 29, 2001 [retrieved Jul. 4, 2007 from Internet Archive Wayback Machine http://www.archive.org/web/php] from the Internet: <URL: http://web.archive.org/web/20011229092917/www.megomuseum.com/catalog/1979/Index.shtml> (1 page).

www.megomuseum.com/catalog/1979/action_figures.shtml webpage dated Aug. 17, 2002 [retrieved Jul. 4, 2007 from Internet Archive Wayback Machine http://www.archive.org/web.php] from the Internet: <URL: http://web.archive.org/seb/20020817055431/www.megomuseum.com/catalog/1979/action_figures.shtml> (2 pgs.).

www.megomuseum.com/catalog/1979/hero_005.shtml webpage dated Aug. 24, 2002 [retrieved Jul. 4, 2007 from Internet Archive Wayback Machine http://www.archive.org/web.php] from the Internet:<URL: http://web.archive.org/web/20020824230213/www.megomoseum.com/catalog/1979/hero_005.shtml> (1 page).

* cited by examiner

ACTION FIGURE TOY

This application claims the benefit of U.S. Provisional Patent Application Ser. No. 60/734,894, filed Nov. 8, 2005. The complete disclosure of the above-identified patent application is hereby incorporated by reference in its entirety for all purposes.

FIELD OF THE DISCLOSURE

The present disclosure relates generally to acrobatic toys and, more particularly, to action figures capable of performing acrobatic stunts.

BACKGROUND OF THE DISCLOSURE

Examples of toys or devices for ascending strings or ropes are disclosed in U.S. Pat. Nos. 240,510, 1,211,479, 1,332,601, 1,961,081, 2,064,119, 2,550,065, 2,565,096, 2,766,551, 3,179,994, 3,393,470, 3,852,943, 4,056,896, 4,253,219, 4,302,902, 4,576,586, 4,881,622, 5,320,572, 5,727,981, 5,743,781, and 6,132,285, and in German Patent No. DE 404,240. The disclosures of these and all other publications referenced herein are incorporated by reference in their entirety for all purposes.

SUMMARY OF THE DISCLOSURE

In one example, an action figure toy may include a base, at least two cords suspended from the base, an action figure, and a flipping mechanism disposed on the base. The action figure may be configured to ascend the at least two cords toward the base by manipulation of the at least two cords by a user. The flipping mechanism may be configured to engage the action figure when the action figure ascends to the flipping mechanism. The flipping mechanism may enable the action figure to rotate about an axis that is transverse to a line parallel to at least a portion of at least one of the at least two cords when the flipping mechanism engages the action figure.

In one example, an action figure toy may include an action figure, a base, an elongate boom, and a rotating mechanism. The action figure may include a torso, at least one arm extending from the torso, an elongate projection disposed on the arm, and first and second openings in the action figure. Each of the respective first and second openings may be obliquely oriented relative to the torso. First and second flexible elongate members may be suspended from the base. The first flexible elongate member may extend through the first opening and the second flexible elongate member may extend through the second opening. The elongate boom may extend from a first end toward a second end. The first end of the boom may be pivotingly mounted to the base. The boom may be pivotingly movable between a first position and a second position, and the boom may be biased toward the second position. The rotating mechanism may be disposed on the second end of the boom. The rotating mechanism may include an axle mounted to the second end of the boom. A flipping member may be mounted to and configured to rotate about the axle between a third position and a fourth position. An elastic rotational biasing member may be mounted to the second end of the boom and engaged with the flipping member. The elastic rotational biasing member may rotationally urge the flipping member toward the fourth position. A latching member may be mounted to the second end of the boom. The latching member may be configured to releasably retain the flipping member in the third position. A receptacle on the flipping member may be configured to engage the elongate projection and releasably retain the action figure proximate the flipping member in a manner that may prevent relative rotation between the action figure and the flipping member.

In one example, an action figure toy may include a base, an action figure, and a flipping mechanism disposed on the base. The action figure may have a body extending along at least one body axis. The flipping mechanism may be configured to engage the action figure. The flipping mechanism may include a rotating mechanism and a translating mechanism. The rotating mechanism may be configured to rotate the action figure about a rotational axis that is transverse to a line parallel to at least one of the at least one body axis. The translating mechanism may be configured to move the action figure relative to the base in a direction that is transverse to a line parallel to the rotational axis.

DETAILED DESCRIPTION

Figure 1:
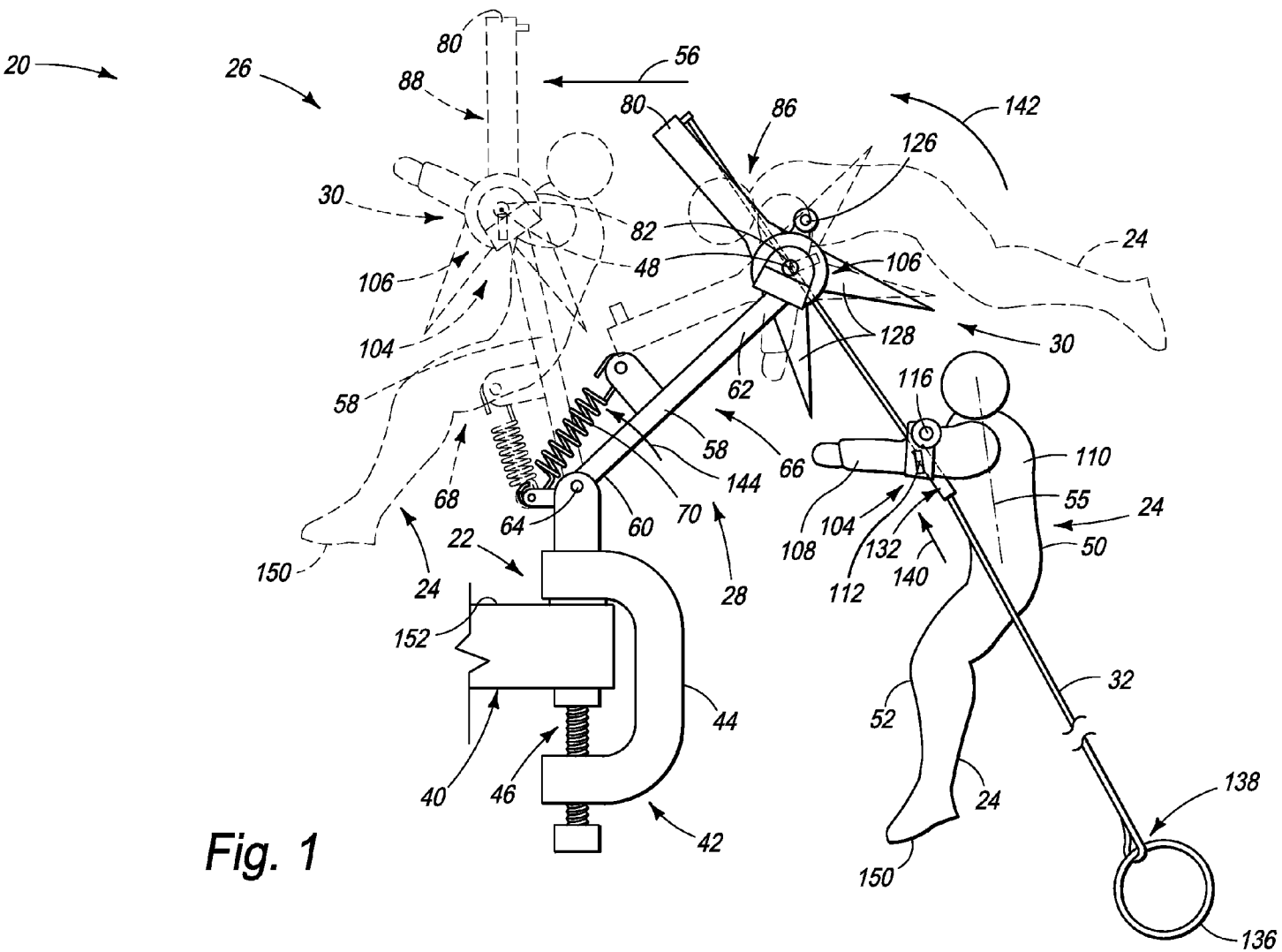
FIG. 1 is a side view of an action figure toy including an illustration of a nonexclusive exemplary functionality of the action figure toy.
Figure 2:
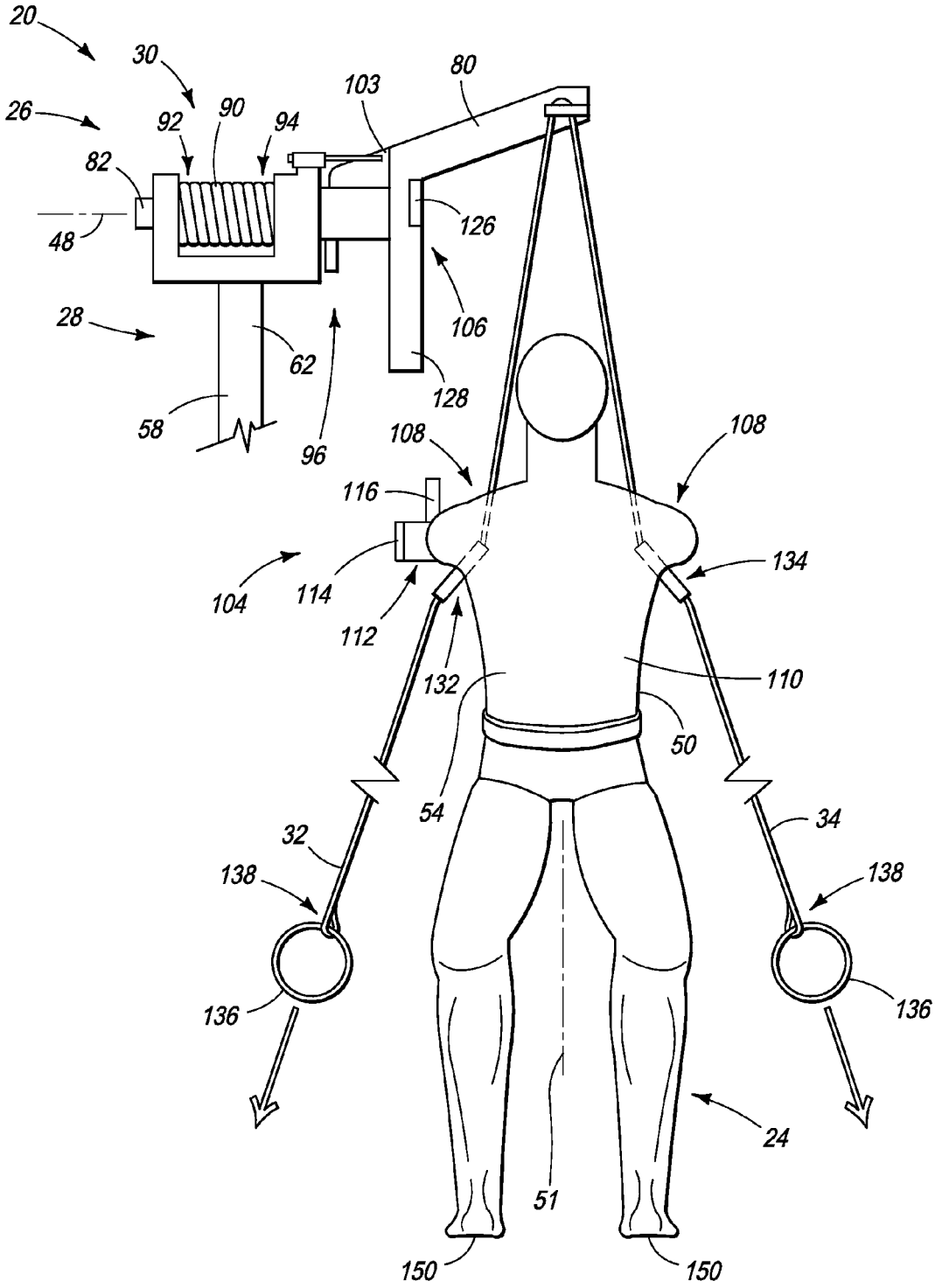
FIG. 2 is a partial rear view of the action figure toy of FIG. 1.
Figure 4:
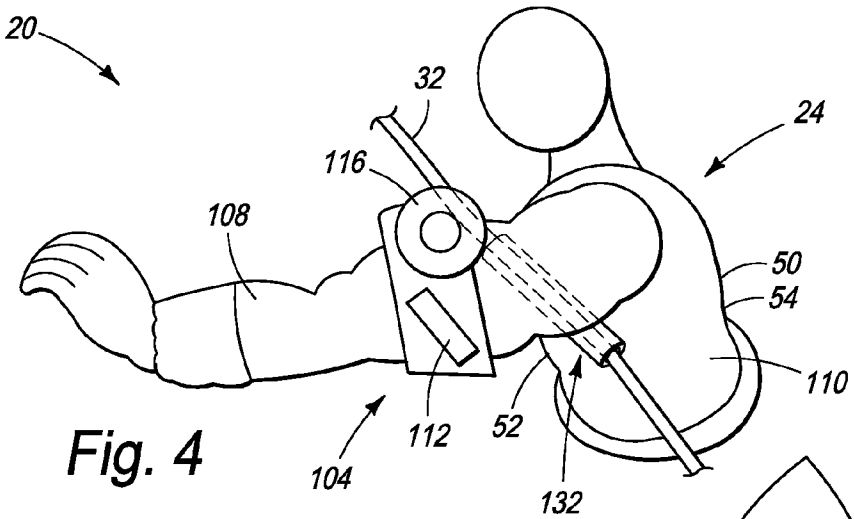
FIG. 4 is a detail view showing a portion of an action figure suitable for use in the action figure of FIG. 1.

A nonexclusive illustrative example of an action figure toy is shown generally at 20 in FIGS. 1 and 2. Unless otherwise specified, action figure toy 20 may, but is not required to, contain at least one of the structure, components, functionality, and/or variations described and/or illustrated herein.

Action figure toy 20 may include a base 22, an action FIG. 24, and a flipping mechanism 26, which may include a translating mechanism 28 and a rotating mechanism 30. In some embodiments, action figure toy 20 may include first and second flexible elongate members or cords 32, 34, which may be suspended from base 22 or flipping mechanism 26, as shown in the nonexclusive illustrative example presented in FIGS. 1 and 2.

The base 22 of the action figure toy 20 may be configured for mounting to any suitable surface or object. For example, as shown in the nonexclusive illustrative example presented in FIG. 1, base 20 may be mounted to the edge 40 of a suitable object or structure, such as a table or counter or the like. Base 20 may include a screw-based clamping mechanism 42. For example, as shown in the nonexclusive illustrative example presented in FIG. 1, clamping mechanism 42 includes a frame 44 adapted to fit over edge 40 and a threaded clamping member 46.

The flipping mechanism 26 may be disposed on base 22 and may be configured to rotate and/or translate action FIG. 24 relative to the base 22. For example, as shown in the nonexclusive illustrative example presented in FIG. 1, flipping mechanism 26 is configured to engage action FIG. 24 such that rotating mechanism 30 rotates action FIG. 24 about a rotational axis 48 while translating mechanism 28 moves action FIG. 24 relative to base 22.

As shown in the nonexclusive illustrative example presented in FIG. 1, rotational axis 48 is generally perpendicular to a sagittal plane 51 (shown in FIG. 2) of action FIG. 24, which is a plane that passes through the body 50 of action FIG. 24 from the front 52 to the back 54. For example, a sagittal plane 51 would correspond to a vertical plane that passes through a standing body and divides the body into left and right portions, with a midsagittal plane dividing the body into relatively mirror-image left and right portions. Thus, an axis, such as rotational axis 48, that is perpendicular to a sagittal plane of a body would run across the body, in a transverse direction, such as from left to right. Further, as shown in the nonexclusive illustrative example presented in FIGS. 1 and 2, rotational axis 48 is transverse to a line parallel to a body axis 55 along which at least a portion of body 50 extends. In such an example, the rotation of action FIG. 24 about axis 48 may be configured to simulate the action figure performing a flip, such as a back flip, as suggested in FIG. 1.

Translating mechanism 30 may be configured to move action FIG. 24 relative to the base 22 in a direction 56 that is transverse to a line parallel to rotational axis 48. For example, as shown in the nonexclusive illustrative example presented in FIG. 1, translating mechanism 30 may include an elongate boom 58. Elongate boom 58 extends from a first end 60 toward a second end 62. The first end 60 of boom 58 is pivotingly mounted to base 22. Boom 58 is configured to pivot about pivot axis 64, such as between a first or tilted position 66 and a second or upright position 68. As shown in the nonexclusive illustrative example presented in FIG. 1, pivot axis 64 is parallel to rotational axis 48. However, in some embodiments, pivot axis 64 may intersect rotational axis 48 or pivot axis 64 and rotational axis 48 may be disposed on skew lines that do not intersect and are not parallel.

Boom 58 may be biased toward upright position 68. For example, as shown in the nonexclusive illustrative example presented in FIG. 1, translating mechanism 30 may include an elastic biasing member 70 that is configured to urge boom 58 toward upright position 68, such as from tilted position 66 toward upright position 68. Elastic biasing member 70 may be of any suitable structure, such as a coil spring or any other suitable elastic element such as a rubber band, a cantilevered structure, or the like. For example, as shown in the nonexclusive illustrative example presented in FIG. 1, elastic biasing member 70, in the form of a coil spring, extends between a first end 72 that is connected to boom 58 and a second end 74 that is connected to base 22. In such an example, elastic biasing member 70 would be in an extended or energized state when boom 58 is in the tilted position 66, as shown in FIG. 1.

Rotating mechanism 28 may be mounted on boom 58. For example, as shown in the nonexclusive illustrative example presented in FIG. 1, rotating mechanism 28 may be mounted on the second end 62 of boom 58.

Rotating mechanism 28 may be configured to rotate action FIG. 24 about rotational axis 48. For example, as shown in the nonexclusive illustrative example presented in FIG. 1, rotating mechanism 28 may include a flipping member 80 that may be pivotingly mounted to flipping mechanism 26. For example, flipping member 80 may be pivotingly mounted to base 22, or flipping member may be pivotingly mounted to the boom 58. As shown in the nonexclusive illustrative example presented in FIGS. 1-5, flipping member 80 is configured to pivot or rotate about axis 48, such as about an axle 82 that is mounted to the second end 62 of boom 58.

Flipping member 80 may be configured to rotate about rotational axis 48 between a first position 86 and a second position 88. As shown in the nonexclusive illustrative example presented in FIGS. 1-5, flipping member 80 may be rotationally biased toward second position 88, such as from first position 86 toward second position 88. For example, as shown in the nonexclusive illustrative example presented in FIGS. 1-5, rotating mechanism 30 may include an elastic rotational biasing member 90 that rotationally biases flipping member 80 relative to axle 82 and the second end 62 of boom 58. In the example presented in FIGS. 1-5, elastic rotational biasing member 90 is configured to rotationally urge flipping member 80 to rotate in a counterclockwise direction (as shown in FIG. 1) relative to boom 58 from first position 86 toward second position 88. Elastic rotational biasing member 90 may include any suitable structure capable of providing flipping member 80 with a rotational bias relative to axle 82 and boom 58, such as a torsional coil spring, or any other suitably configured elastic element such as a rubber band, a cantilevered structure, or the like. For example, as shown in the nonexclusive illustrative example presented in FIGS. 1-5 elastic rotational biasing member 90 is a torsional coil spring disposed about axle 82. A first end 92 of the elastic rotational biasing member 90 is engaged with boom 58 and a second end 94 of elastic rotational biasing member 90 is engaged with flipping member 80. In such an example, elastic rotational biasing member 90 would be in a wound or energized state when flipping member 80 is in the first position 86, as shown in FIG. 1.

Figure 5:
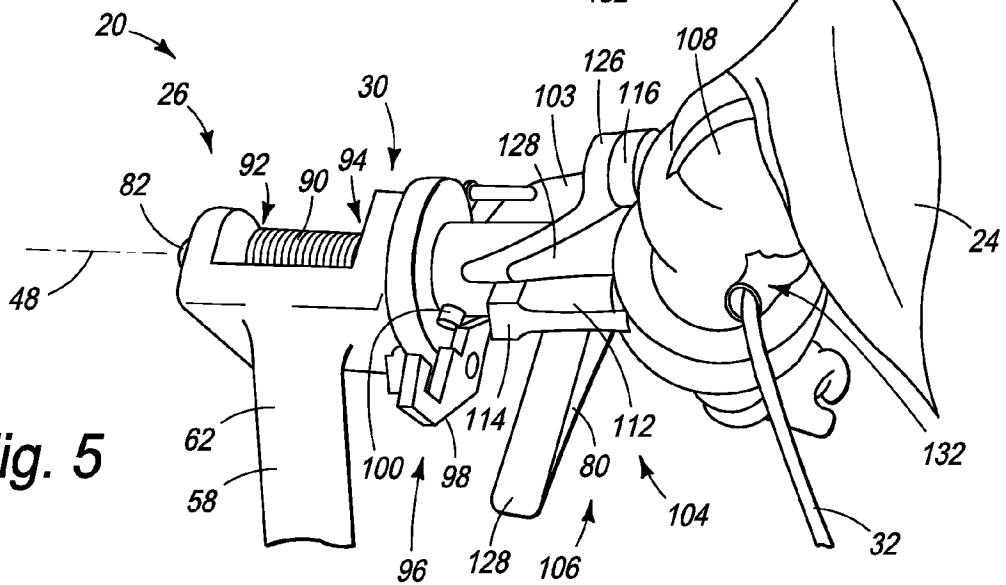
FIG. 5 is a partial perspective view showing a portion of the action figure of FIG. 4 engaged with the flipping mechanism of FIG. 3.
Figure 3:
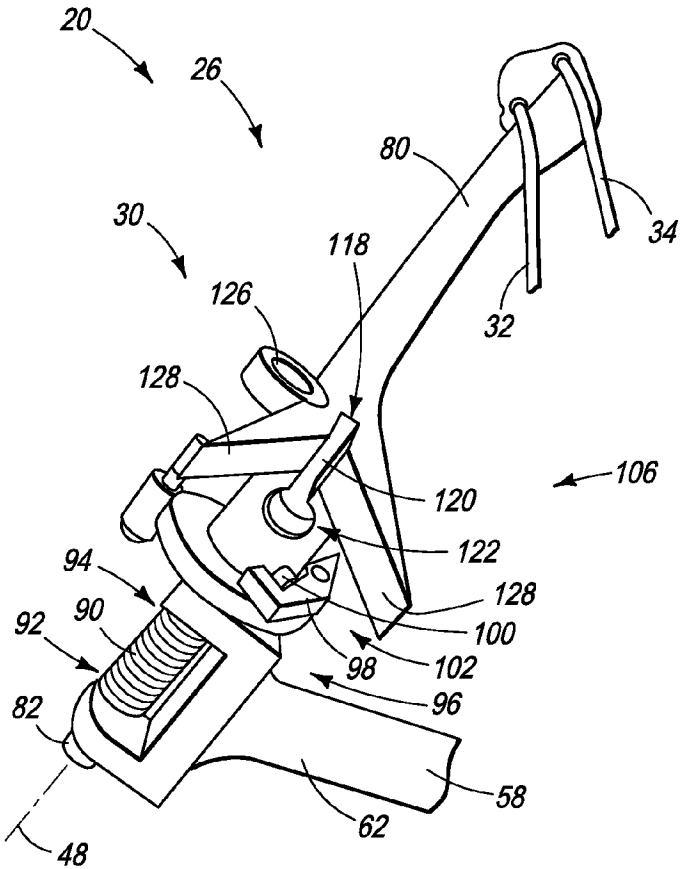
FIG. 3 is a partial perspective view of a nonexclusive illustrative example of a flipping mechanism suitable for use in the action figure toy of FIG. 1.

In some embodiments, rotating mechanism 30 may include a latch 96 configured to retain flipping member 80 in the first position. For example, as shown in the nonexclusive illustrative example presented in FIGS. 3 and 5, a latching member 98 is pivotingly mounted to rotating mechanism 30, such as to the second end 62 of boom 58. Latching member 98 is configured to releasably engage a latching pin 100 that is disposed on flipping member 80, as shown in FIG. 3. When latching member 98 releases latching pin 100, such as shown in FIG. 5, the elastic rotational biasing member 90 may urge flipping member 80 to rotate from first position 86 toward second position 88. In some embodiments, latching member 98 may be retained in an engaged position 102, as shown in FIG. 3, due to the binding force that may be induced between latching pin 100 and latching member 98 due to the rotational bias of flipping member 80, which tends to force latching pin 100 against latching member 98. In some embodiments, the latch may automatically disengage when the binding force between latching pin 100 and latching member 98 is relieved, such as when flipping member 80 is rotated slightly against the rotational bias induced by elastic rotational biasing member 90. In such an embodiment, the automatic disengagement may be due to gravitational effects on latching member 98, which may cause latching member 98 to drop open, as suggested in FIG. 5.

In some embodiments, rotating mechanism 30 may include at least one stop 103, as shown in the nonexclusive illustrative example presented in FIGS. 3 and 5. Stop 103 may be configured to prevent over-rotation of the flipping member. For example, stop 103 may limit the rotation of flipping member 80 towards first position 86 such that elastic rotational biasing member 90 may not be overloaded, and/or stop 103 may limit rotation of flipping member 80 towards second position 88.

Flipping member 80 may be configured to engage action FIG. 24 and rotate action FIG. 24 about rotational axis 48 when flipping member 80 rotates. For example, flipping member 80 may be configured to engage action FIG. 24 and retain action FIG. 24 proximate flipping member 80 in a manner that prevents relative rotation between action FIG. 24 and flipping member 80. As shown in the nonexclusive illustrative example presented in FIGS. 1-5, a first coupling 104 may be disposed on action FIG. 24 and a second coupling 106 may be disposed on flipping member 80.

First coupling 104 may be disposed on an appendage or arm 108 that extends from the body 50 of action FIG. 24, such as from a torso 110 of action FIG. 24, as shown in the nonexclusive illustrative example presented in FIGS. 1-5. For example, first coupling 104 may include an elongate projection 112 disposed on at least one arm 108 of action FIG. 24, as shown in FIG. 1. In some embodiments, such as in the nonexclusive illustrative example presented in FIG. 5, elongate projection 112 may include an enlarged end portion 114.

In some embodiments, first coupling 104 may include a first magnetic-attraction element 116 disposed on arm 108. For example, as shown in the nonexclusive illustrative example presented in FIGS. 1-2 and 4-5, action FIG. 24 includes a first magnetic-attraction element 116 disposed on the arm 108 proximate elongate projection 112. First magnetic-attraction element 116 may be attracted to a magnetic field and/or may itself be a source of a magnetic field. For example, first magnetic-attraction element 116 may include a magnet, such as a permanent magnet or an electromagnet, or any material that is a source of and/or attracted to a magnetic field, such as a magnetic or ferromagnetic material, or the like.

Second coupling 106 may be configured for engagement with first coupling 104 such that action FIG. 24 is retained proximate flipping member 80. For example, as shown in the nonexclusive illustrative example presented in FIGS. 3 and 5, second coupling 106 includes a receptacle or slot 118 that is configured to receive the elongate projection 112 of first coupling 104. Slot 118 includes an opening 120 through which elongate projection 112 protrudes when the first and second couplings are engaged, as shown in FIGS. 3 and 5. Slot 118 includes an enlarged portion 122 that is configured to receive the enlarged end portion 114 of the elongate projection 112. The enlarged portion 122 may be configured to retain the enlarged end portion 114 of elongate projection 112 such that motion of action FIG. 24 in a direction parallel to the rotational axis 48 is prevented when the elongate projection 112 of first coupling 104 is engaged with the slot 118 of second coupling 106. Further, as shown in the nonexclusive illustrative example presented in FIGS. 3 and 5, the engagement between the elongate projection 112 of first coupling 104 and slot 118 of second coupling 106 is configured to prevent relative rotation between action FIG. 24 and flipping member 80.

In some embodiments, second coupling 106 may include a second magnetic-attraction element 126 disposed on the flipping member 80. For example, as shown in the nonexclusive illustrative example presented in FIGS. 1-3 and 5, flipping member 80 includes a second magnetic-attraction element 126 disposed on flipping member 80 proximate slot 118. Second magnetic-attraction element 126 may be complementaries configured with the first magnetic-attraction element 116 such as to provide magnetic attraction between the first and second magnetic-attraction elements 116, 126. For example, second magnetic-attraction element 126 may be attracted to a magnetic field generated by the first magnetic-attraction element 116 and/or second magnetic-attraction element 126 may generate a magnetic field capable of attracting first magnetic-attraction element 116. Second magnetic-attraction element 126 may include a magnet, such as a permanent magnet or an electromagnet, or any material that is a source of and/or attracted to a magnetic field, such as a magnetic or ferromagnetic material, or the like.

As shown in the illustrative example presented in FIG. 5, the first and second couplings 104, 106 are configured such that first magnetic-attraction element 116 is positioned proximate second magnetic-attraction element 126 when the first and second couplings 104, 106 are engaged. In such an example, first magnetic-attraction element 116 is magnetically held proximate second magnetic-attraction element 126 when the first and second couplings 104, 106 are engaged such that action FIG. 24 is retained proximate flipping member 80.

In some embodiments, flipping member 80 may be configured to guide first coupling 104 into engagement with second coupling 106. For example, as shown in the nonexclusive illustrative example presented in FIGS. 1-3 and 5, flipping member 80 includes at least one guiding portion 128, that is configured to guide the elongate projection 112 into slot 118, such as when action FIG. 24 ascends toward the flipping member 80 as will be more fully described below.

In some embodiments, action figure toy 20 may be configured such that a user may cause action FIG. 24 to ascend the first and second flexible elongate members or cords 32, 34, such as toward the base 22, such as by manipulating the first and second flexible elongate members or cords 32, 34. For example, as shown in the nonexclusive illustrative example presented in FIGS. 1-5, where the first and second flexible elongate members or cords 32, 34 are suspended from flipping member 80, action FIG. 24 may be configured to ascend the first and second flexible elongate members or cords 32, 34 toward flipping member 80 and the rotating mechanism 30. In such an example, a user may cause action FIG. 24 to ascend the first and second flexible elongate members or cords 32, 34 until elongate projection 112 becomes received into slot 118 such that the first coupling 104 is engaged with the second coupling 106.

Action FIG. 24 may include first and second spaced-apart openings 132, 134 that extend at least partially through body 50. As shown in the nonexclusive illustrative example presented in FIGS. 1-2 and 4-5, action FIG. 24 includes first and second spaced-apart elongate openings 132, 134, which are obliquely oriented relative to the torso 110 and/or a body axis 55 of action FIG. 24. As shown in FIG. 2, the first flexible elongate member or cord 32 extends through the first opening 132 and the second flexible elongate member or cord 34 extends through the second opening 134.

As suggested in the nonexclusive illustrative example presented in FIG. 2, a user may cause the action FIG. 24 to ascend the first and second flexible elongate members or cords 32, 34 by alternately tensioning the first flexible elongate member or cord 32 and the second flexible elongate member or cord 34. For example, a user may alternately tension the first and second flexible elongate members or cords 32, 34 by alternately pulling on the rings 136 disposed at the free ends 138 of the first and second flexible elongate members or cords 32, 34. Such alternate tensioning of the first and second flexible elongate members or cords 32, 34 tends to cause action FIG. 24 to tilt away from the tensioned one of the first and second flexible elongate members or cords 32, 34 such that the respective one of the first and second openings 132, 134 becomes aligned with the tensioned one of the first and second flexible elongate members or cords 32, 34 and the untensioned one of the first and second flexible elongate members or cords 32, 34 slides through the respective one of the first and second openings 132, 134.

The flipping mechanism 26 and/or the rotating mechanism 30 may be configured such that tensioning of at least one of the first and second flexible elongate members or cords 32, 34 while the first coupling 104 is engaged with the second coupling 106 enables the latching member 98 to become disengaged from latching pin 100. For example, flipping member 80 may be configured such that tensioning of at least one of the first and second flexible elongate members or cords 32, 34 while the first coupling 104 is engaged with the second coupling 106 causes the flipping member to rotate slightly such that latching member 98 becomes disengaged from latching pin 100.

As a nonexclusive illustrative example of operation of action figure toy 20, as suggested in FIG. 1, a user may rotate flipping member 80 towards first position 86 and engage latching member 98 with latching pin 100 such that flipping member 80 is retained in the first position 86. The user may move boom 58 towards tilted position 66, or subsequent forces on boom 58 may tend to urge boom 58 towards tilted position 66. The user may cause action FIG. 24 to ascend 140 the first and second flexible elongate members or cords 32, 34 towards the flipping mechanism 26, such as until the first coupling 104 becomes engaged with the second coupling 106. Additional tensioning of at least one of the first and second flexible elongate members or cords 32, 34 may release latch 96 and enable elastic rotational biasing member 90 to urge flipping member 80 to rotate toward second position 88. The engagement between the first and second couplings 104, 106 permits flipping member 80 to rotate 142 action FIG. 24 about a rotational axis 48, such as about an axis that is transverse to a line parallel to at least a portion of at least one of the first and second flexible elongate members or cords 32, 34. As action FIG. 24 rotates about axis 48, boom 58 may pivot 144 relative to the base 22 about pivot axis 64 from tilted position 66 toward upright position 68, such as due to the urging of elastic biasing member 70 and/or due to the shift in the center of gravity of action FIG. 24 and rotating mechanism 30 relative to base 22 that occurs as action FIG. 24 rotates about axis 48. In some embodiments, flipping mechanism 26 may enable action FIG. 24 to land with its feet 150 standing on surface 152.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the disclosure includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

We claim:

1. An action figure toy, comprising:

a base;

at least two cords suspended from the base;

an action figure configured to travel along and ascend the at least two cords toward the base by manipulation of the at least two cords by a user, wherein the action figure includes a first coupling disposed on the action figure and at least one arm, and the first coupling comprises an elongate projection disposed on the at least one arm and a first magnetic-attraction element disposed on the at least one arm; and a flipping mechanism disposed on the base, wherein the flipping mechanism is configured to:

engage the action figure when the action figure ascends to the flipping mechanism, and enable the action figure to rotate about an axis that is transverse to a line parallel to at least a portion of at least one of the at least two cords when the flipping mechanism engages the action figure;

wherein the flipping mechanism includes:

a flipping member pivotingly mounted to the base and configured to pivot about the axis between a first position and a second position, wherein the flipping member is biased toward the second position, and a second coupling disposed on the flipping member, wherein the second coupling comprises a slot in the flipping member that is configured to receive the elongate projection, the flipping member is configured to guide the first coupling into engagement with the second coupling as the action figure travels along and ascends the at least two cords, the second coupling is configured to engage the first coupling, and the engagement of the first and second couplings retains the action figure proximate the flipping member and prevents relative rotation between the action figure and the flipping member; and wherein the second coupling further comprises a second magnetic-attraction element disposed on the flipping member, the second magnetic-attraction element is complementary with the first magnetic-attraction element to provide magnetic attraction between the first and second magnetic-attraction elements, and the first magnetic-attraction element is magnetically held proximate the second magnetic-attraction element when the elongate projection is received in the slot such that the action figure is retained proximate the flipping member.

2. The action figure toy of claim 1, wherein the axis is generally perpendicular to a sagittal plane of the action figure and the rotation of the action figure is configured to simulate the action figure performing a flip.

3. The action figure toy of claim 1, wherein the at least two cords are suspended from the flipping member and the flipping mechanism further includes a latch, wherein the latch is configured to releasably retain the flipping member in the first position, and the flipping mechanism is configured such that tensioning of at least one of the at least two cords by the user while the first coupling is engaged with the second coupling releases the latch and enables the flipping member to rotate toward the second position.

4. The action figure toy of claim 1, wherein the action figure comprises a torso and first and second spaced-apart, elongate openings in the action figure, wherein each of the respective first and second openings is obliquely oriented relative to the torso, a first one of the at least two cords extends through the first opening, and a second one of the at least two cords extends through the second opening.

5. The action figure toy of claim 4, wherein the first and second openings are configured such that alternate tensioning of the first and second ones of the at least two cords by a user causes the action figure to travel along and ascend the at least two cords.

6. An action figure toy, comprising:

a base;

at least two cords suspended from the base;

an action figure configured to ascend the at least two cords toward the base by manipulation of the at least two cords by a user, wherein the action figure includes a first coupling disposed on the action figure; and a flipping mechanism disposed on the base, wherein the flipping mechanism is configured to engage the action figure when the action figure ascends to the flipping mechanism and enable the action figure to rotate about an axis that is transverse to a line parallel to at least a portion of at least one of the at least two cords when the flipping mechanism engages the action figure, the flipping mechanism including:

a flipping member pivotingly mounted to the base and configured to pivot about the axis between a first position and a second position, wherein the flipping member is biased toward the second position, and the at least two cords are suspended from the flipping member, a second coupling disposed on the flipping member, wherein the flipping member is configured to guide the first coupling into engagement with the second coupling as the action figure ascends the at least two cords, the second coupling is configured to engage the first coupling, and the engagement of the first and second couplings retains the action figure proximate the flipping member and prevents relative rotation between the action figure and the flipping member, a latch, wherein the latch is configured to releasable retain the flipping member in the first position, and the flipping mechanism is configured such that tensioning of at least one of the at least two cords by the user while the first coupling is engaged with the second coupling releases the latch and enables the flipping member to rotate toward the second position, and boom pivotingly mounted to the base, wherein the axis about which the action figure rotates defines a first axis and the boom is configured to pivot about a second axis that is parallel to the first axis between a third position and a fourth position, the boom is biased toward the fourth position, and the boom pivots from the third position toward the fourth position while the flipping member rotates toward the second position.

7. An action figure toy, comprising:

an action figure, comprising:

a torso;

at least one arm extending from the torso;

an elongate projection disposed on the arm; and first and second openings in the action figure, wherein each of the respective first and second openings is obliquely oriented relative to the torso;

a base;

first and second flexible elongate members suspended from the base, wherein the first flexible elongate member extends through the first opening and the second flexible elongate member extends through the second opening;

an elongate boom extending from a first end toward a second end, wherein the first end of the boom is pivotingly mounted to the base, wherein the boom is pivotingly movable between a first position and a second position, wherein the boom is biased toward the second position; and a rotating mechanism disposed on the second end of the boom, the rotating mechanism comprising:

an axle mounted to the second end of the boom;

a flipping member mounted to and configured to rotate about the axle between a third position and a fourth position;

an elastic rotational biasing member mounted to the second end of the boom and engaged with the flipping member, wherein the elastic rotational biasing member rotationally urges the flipping member toward the fourth position;

a latching member mounted to the second end of the boom, wherein the latching member is configured to releasably retain the flipping member in the third position; and a receptacle on the flipping member, wherein the receptacle is configured to engage the elongate projection and releasably retain the action figure proximate the flipping member in a manner that prevents relative rotation between the action figure and the flipping member.

8. The action figure toy of claim 7, wherein:

the first and second flexible elongate members are suspended from the flipping member;

the first and second openings are configured such that alternately tensioning the first and second flexible elongate members enables the action figure to ascend the first and second flexible elongate members toward the rotating mechanism until the elongate projection becomes engaged with the receptacle; and the rotating mechanism is configured such that tensioning at least one of the first and second flexible elongate members while the elongate projection is engaged with the receptacle enables the latching member to release the flipping member and the elastic rotational biasing member to urge the flipping member toward the fourth position.

* * * * *